United States Patent [19]

Connor

[11] 4,309,894

[45] Jan. 12, 1982

[54] AUTO BODY REPAIR TOOL

[76] Inventor: Marc A. Connor, 4348 Rustlewood La., Doraville, Ga. 30360

[21] Appl. No.: 91,683

[22] Filed: Nov. 5, 1979

[51] Int. Cl.[3] ..... B21D 1/12

[52] U.S. Cl. ..... 72/457; 72/705

[58] Field of Search ..... 72/705, 457

[56] References Cited

U.S. PATENT DOCUMENTS 4,201,076 5/1980 Jarman et al. ..... 72/705

OTHER PUBLICATIONS

Padgett Puller by O'Neal Steel Products Co., pp. 1–4.

*Primary Examiner*—Lowell A. Larson

*Attorney, Agent, or Firm*—Steele, Gould & Fried

[57] ABSTRACT

Apparatus for the repair of automobiles of unitized body and frame construction comprises a shank member attached to one or more flange members, said flange members adapted for direct connection to the suspension mounting strut on the inner apron of an automobile fender. The apparatus provides a secure attachment to the suspension mounting strut, and means for applying force thereto, for use as a means of securing the automobile during work, as well as a means of correcting suspension misalignment.

5 Claims, 6 Drawing Figures

AUTO BODY REPAIR TOOL

BACKGROUND OF THE INVENTION

1. Field of the Invention

This invention relates to the field of automobile body repair, and in particular to the art of realignment of automobile suspensions, on automobiles having a unitized body/frame construction. The invention is most useful after the automobile suffers collision damage, but may also be used for correction of misalignment developed during normal use.

2. Description of the Prior Art

The unitized body/frame design for automobiles is a comparatively recent development. In the unitized design, automobile body members are welded into a solid piece, and suspension members are mounted directly on the body. The body is strengthened by channels included therein, and functions as a frame as well as a body. The design precludes the necessity of a heavy steel frame upon which to mount the automobile body, thereby resulting in lighter, more fuel-efficient cars. Due to their decreased weight and cost, these unitized body/frame cars have recently become very popular.

Automobiles of a unitized body/frame construction often include the so-called McPhearson strut or a variation thereof. In this arrangement, the inner fender structure of the automobile comprises a protrusion having a flat apron at the top. The suspension, including the shock absorber and springs, is mounted inside the fender directly to holes in said apron, using bolts. The protrusion extends into the engine compartment, and is generally smooth in shape.

Although the unitized body/frame construction has advantages in terms of weight, the design has disadvantages in terms of strength. A minor collision which might have caused only cosmetic damage in a former automobile design can easily cause structural misalignment in a unitized body/frame automobile. Since a minor fender-bender collision can so easily result in misalignment of the automobile suspension, and resultant excessive tire wear, poor handling and poor fuel efficiency, it will be appreciated that a convenient method of correcting structural misalignment would be quite useful to the automobile industry.

Systems employing clamps and hydraulic force mechanisms have been developed for repair of automobile bodies. These systems generally relate to correcting cosmetic damage, such as dents, by drawing the crumpled or dented body member out into a relatively more smooth shape. Reference can be made to U.S. Pat. No. 3,276,237—Transue for an example of such a system. A hydraulic cylinder operates a lever which is attached by means of a chain to a clamp. The clamp is attached to the automobile body by friction. A friction-secured clamp may of course be pulled free when a force sufficient to correct structural damage is applied. Should the friction clamp remain attached, the clamp is likely to gouge or otherwise mar the surface upon which it is affixed. This coincidental damage causes additional work and expense in repairing automobile bodies by this method. In addition, the insecurity of a friction clamp connection can contribute to human injury should a workman be struck by the suddenly-freed chain and clamp.

For reasons of both aesthetics and aerodynamics, automobile bodies are constructed in smooth shapes. Smooth-shaped bodies present few points at which a friction clamp can be affixed. Clamps are therefore sometimes adapted to be affixed to the edge of a curving body member. As correction of a misaligned suspension mount entails bending of a smooth surface, an edge-mounted clamp is not useful.

Final finishing of automobile body repair is done by carefully filling in and sanding off any remaining irregularities in the body members. These final phases of automobile body repair are most easily done when the car body is held as steady as possible. Without some support, the car will tend to rock on its springs while forces are applied in the repair operations. To avoid such rocking, the car may be supported by its body, or a force may be applied to hold the body in tension against its springs.

The present invention is intended to address these and other problems in the field of automobile body repair. The secure attachment between the invention and the apron upon which the suspension is mounted allows application of great forces without danger of slippage. The invention is designed to fit directly onto the suspension mount, using the bolts already available. Therefore, the automobile body need not be further damaged by a friction clamp, or otherwise. Once installed the invention will not pull free and will not slip and mar the surface. This secure mounting provides an entirely safe method of applying the great forces necessary to straighten an automobile suspension, as well as a convenient means for holding the automobile body steady during work.

SUMMARY OF THE INVENTION

It is a primary object of this invention to facilitate repair of collision damage in automobiles of a unitized body/frame construction.

It is also an object of this invention to provide a safe and secure means for applying force to realign the suspension of a unitized body/frame automobile.

It is another object of this invention to avoid unnecessary damage to an automobile during repair of body damage, or during a regular realignment.

It is still another object of this invention to provide a conveniently-installed apparatus for exertion of force upon an automobile.

These and other objects of the invention are provided by an apparatus for repair of automobiles of the type having a unitized body and frame construction utilizing a McPhearson strut or the like, said apparatus comprising a first flange member adapted for connection to the top of said McPhearson strut; at least one shank member extending upwards perpendicular to the plane of said flange member and rigidly-connected to said flange member; and means for exerting force against said at least one shank member. The apparatus may be conveniently adapted for use on more than one variety of automobile, by use of at least one additional flange member adapted for connection to a McPhearson strut of different dimensions, said additional flange member rigidly connected to the shank member on the end opposite said first flange member. Force may be applied to the invention as described, by connection of a force-applying mechanism to at least one shank flange rigidly connected along said at least one shank member, said shank flange adapted for connection to the external force.

DETAILED DESCRIPTION OF THE DRAWINGS

Figure 1:
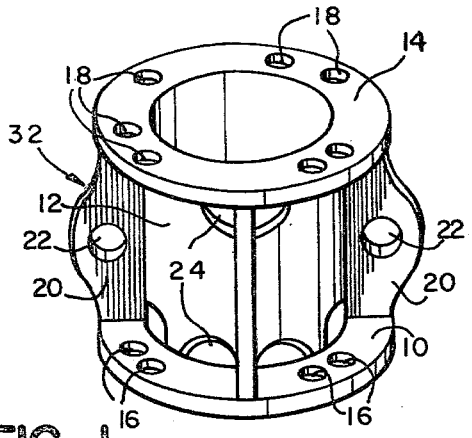
FIG. 1 is a perspective view of the invention, adapted for use on at least two types of cars.

FIG. 1 illustrates a preferred embodiment of the invention. First flange member 10 is adapted for connection to bolts on the top of a McPhearson strut, by bolt holes 16 in said first flange member. Shank member 12 is rigidly connected to said first flange member 10, and wrench clearance holes 24 are provided for convenience in tightening the invention onto a McPhearson strut by means of bolts. Additional flange member 14 is affixed to the opposite end of said shank member 12. Additional flange member 14 is likewise adapted for connection via bolts to a McPhearson strut. However, additional flange member 14 is adapted for connection to a McPhearson strut having a different bolt alignment. Both first flange member 10 and additional flange member 14 may be provided with multiple bolt holes 16, 18 for use on more than a single strut design. Shank flanges 20 are attached along the sides of shank member 12, and are equipped with holes 22 for connecting an external force to the invention.

Figure 2:
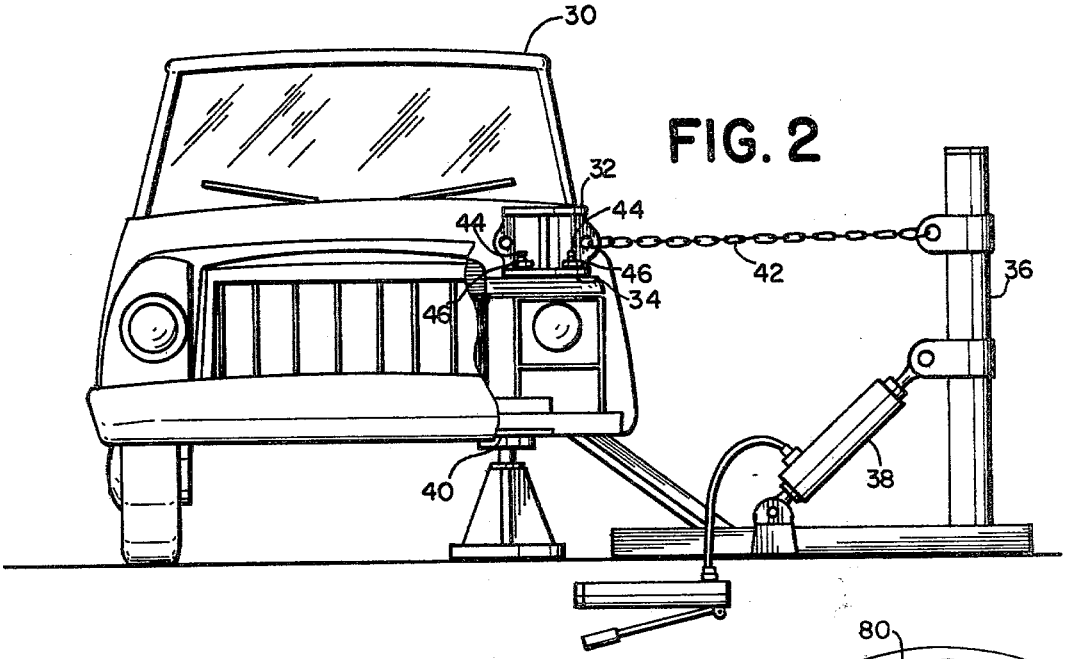
FIG. 2 is a perspective view of the invention, in use in correcting the alignment of an automobile suspension.

With reference to FIGS. 1 and 2, in operation the repairman removes the nuts 46 from the suspension mount at the top of the inner fender apron 34 of the automobile, places first flange 10 down over the bolts 44 in said mount, and replaces and retightens nuts 46. During this operation, wrench clearance holes 24 allow free movement of the wrench. When the nuts 46 are completely tightened, the repairman conveniently connects an external force via shank flange holes 22. This connection may be made by means of a hook and chain, a rope, a lever bar, or any appropriate means.

FIG. 2 illustrates the invention installed on an automobile, and in use for correcting misalignment of the suspension. Automobile 30 having suffered collision damage, the repairman has installed the invention 32 on the McPhearson strut at the top of the inner fender apron 34, as above-described. A hydraulic pulling apparatus 36 is connected via chain 42 to said invention. Pulling apparatus 36 is opposed at tie point 40 by the weight of car 30 on said pulling apparatus. Alternatively, pulling apparatus 36 might be opposed by use of the invention on the both inner fender aprons, and use of a second pulling apparatus in opposition to the first. To straighten the suspension, the repairman pumps up hydraulic cylinder 38, thereby exerting force against the invention through chain 42, and thereby bending inner fender apron 34 into proper alignment.

As apparatus 32 provides a secure connection to the automobile suspension, the repairman might exert force on the suspension through apparatus 32 by any convenient method. For example, the repairman might use a bar or other lever directly on apparatus 32 to align the suspension in a more direct fashion. The repairman might also connect more than one pulling apparatus 36 to apparatus 32 for application of a resultant force in another direction, or for more complicated repairs.

Having completed the realignment, the repairman removes the nuts holding the apparatus to the inner fender apron 34, removes the apparatus 32, and reconnects the suspension by tightening down the bolts.

As the invention comprises a secure connection to the automobile without damage thereto, many functions can thus be performed. The invention may be used to lift the entire vehicle, to mount other equipment directly to the automobile body, to tow the automobile, or any other function requiring secure attachment to the auto body.

Figure 3:
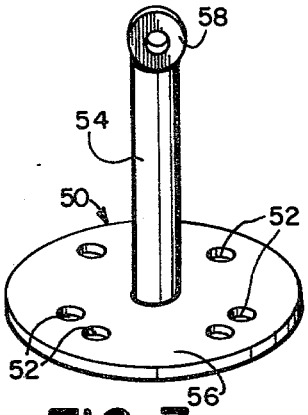
FIG. 3 is a perspective view of an alternative embodiment of the invention.
Figure 5:
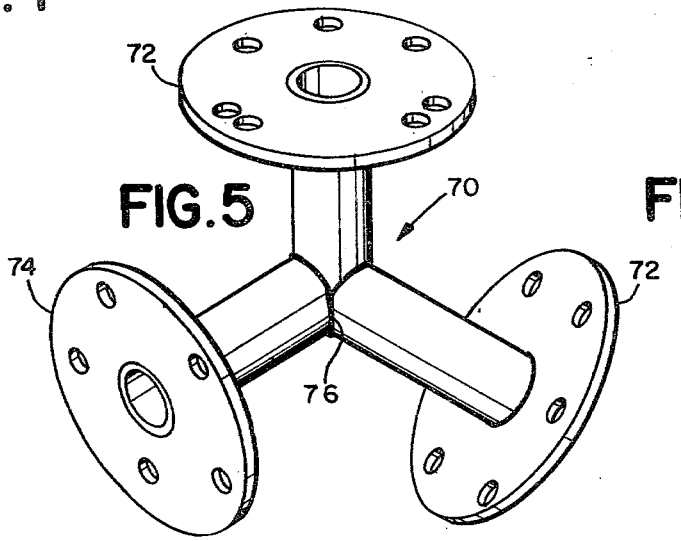
FIG. 5 is a perspective view of an alternative embodiment of the invention.
Figure 4:
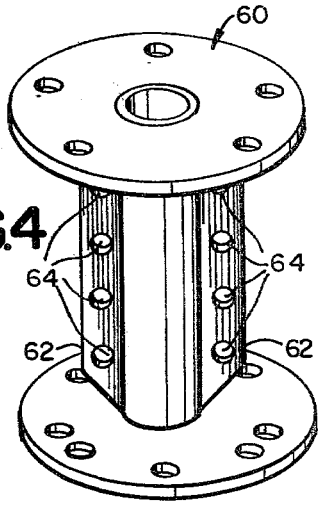
FIG. 4 is a perspective view of an alternative embodiment of the invention.

FIGS. 3–5 illustrate some alternative embodiments of the invention. Single flange unit 50, shown in FIG. 3, is designed for use on more than one variety of suspension strut, yet has only one flange member. Holes 52 are provided in various places on flange member 56 to accomodate different makes of vehicle. Force may be applied to unit 50 via ring 58 secured to tubing 54.

In long shank unit 60, shown in FIG. 4, shank flanges 62 are provided with multiple holes 64 for adjustable leverage. To provide greater leverage, the repairman connects the external force to a hole 64 farther from the inner fender apron.

In FIG. 5, multiple flange member 70 illustrates that flange members for a variety of automobiles may be connected together. The various flange members 72, 74 are each attached to shanks which are connected at weld 76. Should flange 74 be used to connect to the suspension, force may be applied at either remaining flange 72. This force may be an external force mechanism as illustrated in FIG. 2, or could be leverage exerted via manual force on a bar inserted into either remaining flange member 72. Where flange members 72, 74 are each adapted for use on more than one variety of automobile, a large number of automobiles may be repaired with a single tool.

Figure 6:
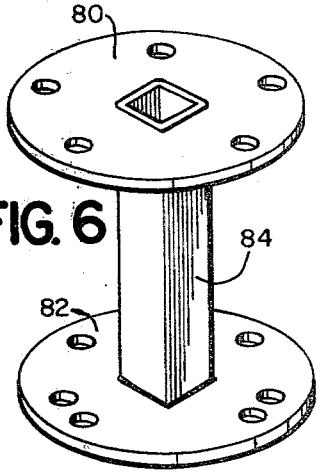
FIG. 6 is a perspective view of an alternative embodiment of the invention.

FIG. 6 shows an alternate embodiment in which flanges 80, 82 are joined by square tubing 84.

The units illustrated in FIGS. 1 through 5 show connection of the flange and shank members by welding. The flange and shank members may also be cast as one piece, threaded together, or connected in any other suitable manner.

The foregoing is a description of preferred embodiments of this invention. Other embodiments can readily be conceived which do not depart from the spirit of this invention. Accordingly, reference should be made to the following claims rather than the foregoing specification to determine the scope of the invention.

I claim:

1. An apparatus for repairing vehicles of the type utilizing unitized body and frame construction having McPhearson struts and the like which include upwardly extending bolts which vary in arrangement among the vehicles, said apparatus comprising:

a first flange having a plurality of holes spaced to conform to at least one arrangement of said bolts, for connection to the strut and for connection to a force exerting means;

a shank member rigidly connected to and extending from the first flange, the shank member having means for connection to a force exerting means; and, a second flange rigidly connected to the shank member opposite said first flange and having a plurality of holes spaced to conform to at least a second arrangement of said bolts and for connection to a force exerting means;

whereby the apparatus may be attached to the struts of any of said vehicles by one of said flanges and whereby forces may be applied to the apparatus at a plurality of points on the shank member and the other, unconnected flange.

2. The apparatus for repairing vehicles as in claim 1, wherein the shank member is a hollow tube extending through the first and second flanges, whereby force may be exerted by insertion of a lever into the hollow of the shank member.

3. The apparatus for repairing vehicles as in claim 1, wherein said means for connection to said force exerting means on the shank member comprises at least one outwardly extending shank flange rigidly connected along the shank member.

4. The apparatus for repairing vehicles as in claim 3, wherein said shank flange is adapted for connection to an external force at regular points along its length.

5. The apparatus for repairing vehicles as in claim 1 further comprising wrench clearance holes in said shank member, said wrench clearance holes disposed along said shank member at the junction between said shank member and said flange member, and disposed around said shank member at points of closest proximity to said bolt holes.

* * * * *